US008960527B2

(12) United States Patent
Hui

(10) Patent No.: US 8,960,527 B2
(45) Date of Patent: Feb. 24, 2015

(54) FOLDABLE BOXES

(71) Applicant: Papillon Ribbon & Bow, Inc., Clifton, NJ (US)

(72) Inventor: Vanessa Hui, Kowloon (HK)

(73) Assignee: Papillon Ribbon & Bow, Inc., Clifton, NJ (US)

( * ) Notice: Subject to any disclaimer, the term of this patent is extended or adjusted under 35 U.S.C. 154(b) by 0 days.

(21) Appl. No.: 14/266,322

(22) Filed: Apr. 30, 2014

(65) Prior Publication Data

US 2014/0231498 A1 Aug. 21, 2014

Related U.S. Application Data

(62) Division of application No. 11/113,437, filed on Apr. 22, 2005, now Pat. No. 8,857,702.

(51) Int. Cl.

| | |
|---|---|
| ***B65D 5/36*** | (2006.01) |
| ***B65D 5/42*** | (2006.01) |
| ***B65D 5/24*** | (2006.01) |
| ***B65D 5/66*** | (2006.01) |

(52) U.S. Cl.

CPC ..... *B65D 5/4283* (2013.01); *B65D 5/241* (2013.01); *B65D 5/36* (2013.01); *B65D 5/6611* (2013.01); *B65D 5/3635* (2013.01); *B65D 2313/02* (2013.01); *B65D 2313/04* (2013.01); *B65D 2313/08* (2013.01)

USPC ..... 229/117; 229/122.27; 229/122.34

(58) Field of Classification Search

USPC ..... 229/117, 117.07, 122.27, 122.32, 229/122.34

See application file for complete search history.

(56) References Cited

U.S. PATENT DOCUMENTS

| | | | | |
|---|---|---|---|---|
| 3,638,852 | A * | 2/1972 | Solanka | 229/117.01 |
| 3,837,561 | A * | 9/1974 | Rubin | 229/116.5 |
| 4,477,015 | A * | 10/1984 | Lozaun | 229/122.34 |
| 5,183,200 | A * | 2/1993 | Okamoto | 229/117.01 |
| 5,586,717 | A * | 12/1996 | Hallam | 229/122.32 |
| 6,109,513 | A * | 8/2000 | Dugan | 229/117 |
| 7,686,206 | B2 * | 3/2010 | Bondarik | 229/122.32 |
| 8,657,184 | B2 * | 2/2014 | Gao | 229/122.34 |
| 2010/0314436 | A1 * | 12/2010 | Tao | 229/122.32 |

* cited by examiner

*Primary Examiner* — Gary Elkins

(74) *Attorney, Agent, or Firm* — Feldman Law Group, P.C.; Stephen E. Feldman

(57) ABSTRACT

A foldable box that includes a cover; a bottom; a right side; a front side; a left side; a rear side; an outside connector; a front connector; and a rear connector. The cover and the bottom can be foldably connected to the outside connector. The right side, the front side, the left side and the rear side can be foldably connected to each other. Also, a portion of the front connector can be foldably connected to a bottom edge of the left side, a portion of the front connector can be foldably connected to a bottom edge of the front side, a portion of the rear connector can be foldably connected to a bottom edge of the rear side and a portion of the rear connector can be foldably connected to a bottom edge of the right side.

4 Claims, 5 Drawing Sheets

FOLDABLE BOXES

CROSS-REFERENCE TO RELATED APPLICATIONS

This application is a divisional of U.S. patent application Ser. No. 11/113,437, filed on Apr. 22, 2005, now pending, which patent application is incorporated here by reference in its entirety to provide continuity of disclosure.

BACKGROUND

The present invention generally relates to a foldable box. More particularly, the present invention relates to a box that is stored flat and folds into a three-dimensional box. Boxes are used everyday for many purposes. They are used for storage, shipping and even gift-giving. Because of the variety of uses, boxes come in a variety of sizes and shapes. From boxes that hold a small piece of jewelry to ones that hold refrigerators.

But when a box is manufactured by a manufacturing company the box is usually shipped in a three-dimensional form. The manufacturing company than must pay for additional shipping cost for empty space within the box. Additionally, the boxes are also more susceptible to damage when shipped in this fashion.

To overcome these shipping problems, box designers have made collapsible boxes. These boxes are shipped flat and need to be constructed by the ultimate user of the box.

To construct these boxes, the user must unfold the box and place certain folds into certain slots, or in the alternative use glue or tape. These actions are time consuming and labor intensive. Stores must pay for this extra time to construct these boxes. The consumer at the store also has a delay because the boxes will usually be constructed in front of the consumer. This delay results in loss time for all parties involved.

Some stores in order not to delay the customer may employ extra personnel to build boxes. This, however, does not alleviate all of the stores problems because now the store must find space to store the boxes in their three-dimensional form. This means there will be less space for the products in which they stock.

SUMMARY

The present invention overcomes the problem of the conventional art by constructing a foldable box that is stored in a flat position. In order to fold the box into a three dimensional position, all a user must do is unfold one piece of the box which will in turn construct the whole box.

Foldable boxes of this sort comprise a bottom panel, a plurality of sides panels, and at least four connectors having a first portion and a second portion whereby the first portion of each connector is foldably connected to a side panel. The second portion of each connector is then adhered to a second side panel with the first and second side panels being adjacent to one another.

Furthermore, all of the side panels have a bottom edge. The bottom edge of the side panels are foldably connected to said bottom panel.

The box also has a holding means for holding the foldable box in a constructed form. The holding means can be placed on an inner corner of said side panels. The inner corner being between the adhered connector and the edge of said side panel. The holding means may be a peelable adhesive or Velcro strip or any other device which will serve the same purpose.

In another embodiment, the foldable box comprises a bottom panel, a cover, a retaining lip, a plurality of sides panels and at least four connectors with the connectors having a first portion and a second portion. The first portion of each connector is foldably connected to a first side panel. The second portion of said each connector is adhered to a second side panels. The first and second side panels being adjacent to one another.

The side panels have a bottom edge. The bottom edge of the side panels are foldably connected to said bottom panel. The cover is foldably connected to a top of one of said side panels. A lip is foldably connected to the cover opposite to the side panel foldably connected to the cover.

To place the box in a closed constructed position the cover is placed on a top portion of the sides. The lip then falls onto the entire side panel opposite to the side panel foldably connected to the cover and is locked into place.

A holding means is then placed on an inner corner of said side panels. The inner corner being between the adhered connector and the edge of said side panel. The holding means can be a peelable adhesive or Velcro strip.

The holding means may also be a foldable member located on one of said side panels.

In a third embodiment, the foldable box comprises a bottom panel, a plurality of side panels, a first connector, a second connector, a cover and a cover connector.

The plurality of side panels consist-of a front panel, a back panel, a left panel and a right panel, and each side panel consists of a left portion, a right portion, a top portion and a bottom portion.

The connectors each have a first portion and a second portion. The first portion of the first connector foldably connects to the bottom portion of said left panel and is substantially adhered to the bottom panel. The second portion foldably connects to the bottom of the front panel and the bottom.

The first portion of the second connector foldably connects the bottom of the back panel and the bottom of the right panel. The sides are each connected to each other on the right and left portions, respectively.

To construct box from a flat position to a working position a user pulls the sides to an upright position and folds the cover on tops of the sides.

In another embodiment, a foldable box comprises: a cover; a bottom; a right side; a front side; a left side; a rear side; an outside connector; a front connector; and a rear connector, the cover being foldably connected to the outside connector at a first crease, the bottom being foldably connected to the outside connector at a second crease, the right side being foldably connected to the front side at a third crease, the front side being foldably connected to the left side at a fourth crease, the left side being foldably connected to the rear side at a fifth crease, the rear side being foldably connected to the right side at a sixth crease, the front connector having a first portion and a second portion being separated by a seventh crease, the rear connector having a third portion and a fourth portion being separated by an eighth crease, the first portion of the front connector being foldably connected to a bottom edge of the left side, the second portion of the front connector being foldably connected to a bottom edge of the front side, the third portion of the rear connector being foldably connected to a bottom edge of the rear side and the fourth portion of the rear connector being foldably connected to a bottom edge of the right side.

In some implementations, when the box is in three-dimensional form, the right side, the front side, the left side and the rear side can be in upright positions and/or when the box is in three-dimensional form, the outside connector can be folded over the rear side and the cover is folded over an opening created by the right side, the front side, the left side and the rear side and/or when the box is in three-dimensional form, the front connector and the rear connector can be adjacent to one another and lay flat against a top side of the bottom.

BRIEF DESCRIPTION OF THE DRAWINGS

The following description of preferred embodiments of the present invention will be better understood when read in conjunction with the appended drawings. It should be understood, however, that the invention is not limited to the precise arrangements shown.

DETAILED DESCRIPTION

Manufactures of boxes often run in to difficulty when shipping boxes because of the way in which they are shipped. To cut down on shipping cost it is more cost efficient to ship boxes in a flat position. However, flat boxes must be assembles to the party it is shipped to. This takes time on the part of the ultimate user.

To cut down on this time, a box can be constructed in such a way as to make the assembly time to construct a box minimal. This is accomplished by having foldable connectors attached to certain parts of the box. When the box is flat the connectors are also flat. To construct a box a user must only lift one part of the box. This triggers a chain reaction and as the user pulls the part the connectors in turn pull other parts of the box. The box is then fully three dimensional with minimal work on the part of the user. The user will not have to add any additional glue or tape to the box.

The boxes may be constructed out of any material that may be foldably connected such as all types of cardboard and flexible plastics. The material may also be decorated so the box is aesthetically pleasing to the eye. This is accomplished by lining the material with certain types of laminate and cloth-like materials.

Figure 1:
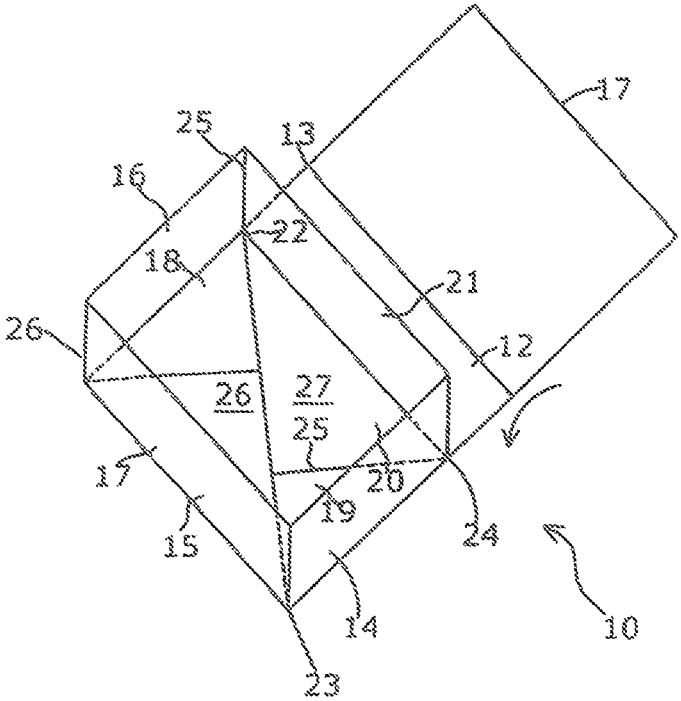
FIG. 1 is a perspective view of the first embodiment of the present invention in its constructed form.

FIG. 1 is one embodiment of the present invention. In FIG. 1, the box 10 is in its three-dimensional form. The box has a cover 11 that is foldably connected to an outside connector 12 at crease 13. The outside connector is also foldable connected to the bottom of the box (not shown) at crease 22.

The boxes have a right side 14, a front side 15, a left side 16 and a rear side 21. Right side 14 is foldable connected to front side 15 at crease 23. Front side 15 is foldable connected to left side 16 at crease 26. Left side 16 is foldable connected to rear side 21 at crease 22. Rear side 21 is foldably connected to right side 14 at crease 24.

The box also has a front connector 26 having portions 17 and 18 and rear connector having portions 19 and 20. Portion 18 of the front connector is adhered to the bottom of the box and is foldably connected to the bottom of the left side 16. Portion 17 is foldable connected to portion 18 and the bottom side of the front side 17.

The rear connector 27 is connected between the bottom of back side 21 and the bottom of right side 14. The rear connector is folded in two parts at crease 25.

FIG. 1 shows the box in its constructed form with the sides 14, 15, 16 and 21 in an upright position. The connectors 26 and 27 are on top of the bottom portion not allowing the bottom to visible.

Figure 2:
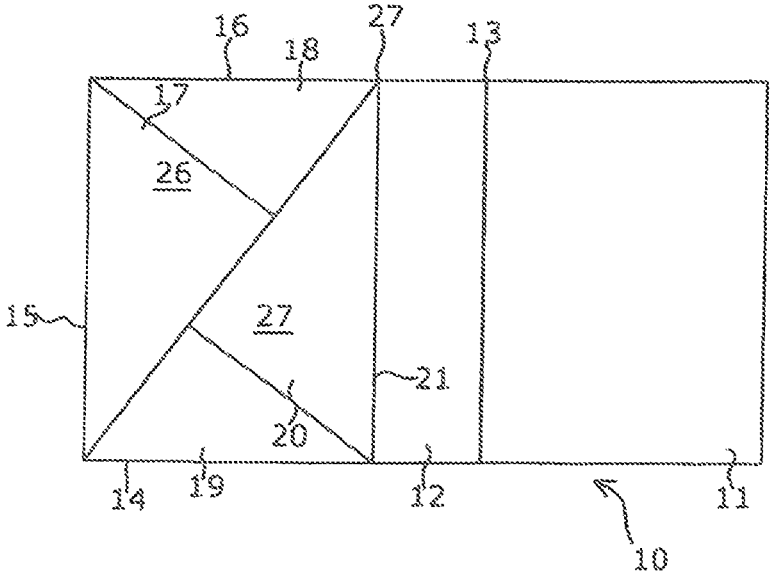
FIG. 2 is a top view of the first embodiment of the present invention in its constructed form.

FIG. 2 shows the foldable box 10 from a top view in its constructed position. From this view point, the bottom of the box is split into four sections. Sections 17 and 18 represent one connector 26 and sections 19 and 20 represent the second connector 27. These connectors 26 and 27 when in their unfolded state cover the entire bottom layer of the box.

The cover is connected to connector 12 at crease 13. If a user wanted to close the box 10. The user will lift the cover 11 and fold the cover over the opening created by sides 14, 15, 16 and 21. The connector 12 then rests on side 21.

Figure 3:
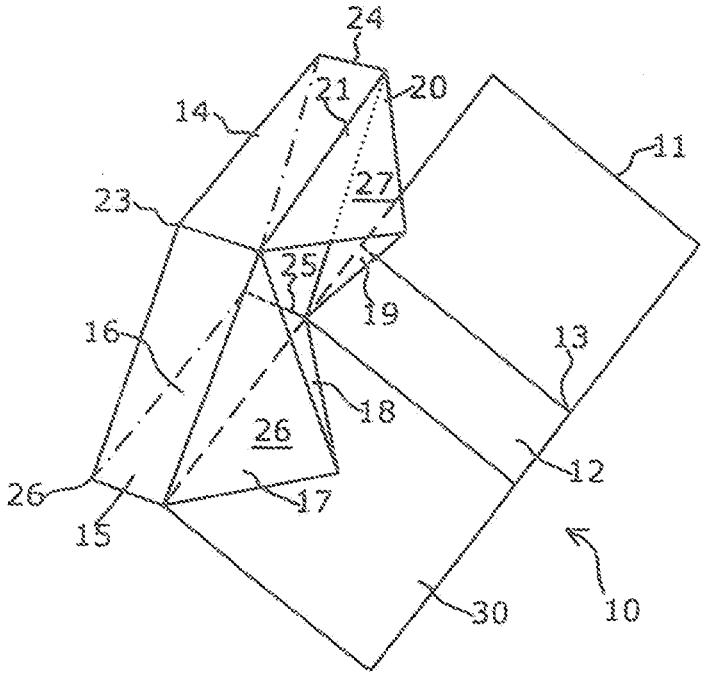
FIG. 3 is a perspective view of the first embodiment of the present invention in its transition from a flat unfolded box to its constructed form.

FIG. 3 shows the box in use as the box is folded from a flat state to a box shape. The sides 14, 15, 16 and 21 are shown. These sides are all interconnected as discussed above.

The connector 18 is adhered to the bottom of the box 30 and is connected to side 15 at crease 31. The other portion of connector 26 is connected to the bottom of side 14.

Connector 27 is connected to the bottom of side 16 and 21. The connector 27 while opening forms a triangular shape.

The bottom 30, cover 11 and connector 12 all remain flat while the sides of the box are formed.

Figure 4:
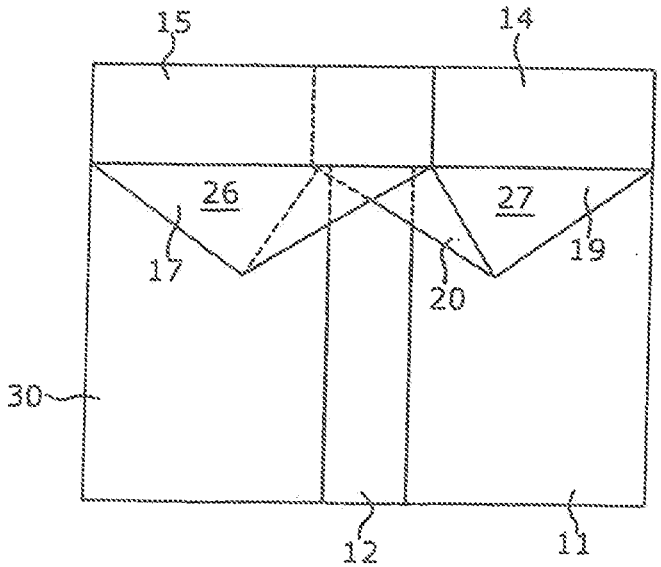
FIG. 4 is a top view of the first embodiment of the present invention in its flat, unfolded form.

FIG. 4 shows the box in its flat position. Sides 14 and 15 are visible from the top. While sides 16 and 21 are covered by sides 14 and 15.

Connectors 26 and 27 are also folded so as to form two triangular areas.

Figure 5:
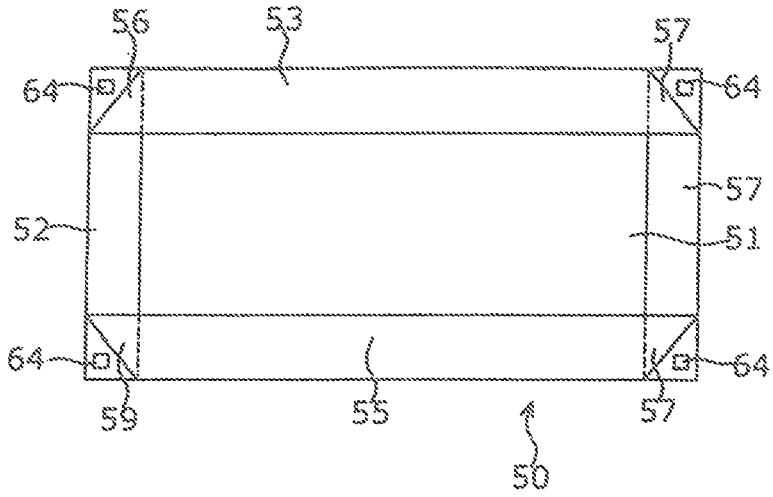
FIG. 5 is a top view of the second embodiment of the present invention in its flat, unfolded form.

FIG. 5 is another embodiment of the foldable box. This foldable box 50 has a cover which is separately assembled and is not foldably connected to the box.

In this embodiment the box 50 has a bottom 51 and four sides 52, 53, 54 and 55. The sides 52, 53, 54 and 55 are foldably connected to the bottom by four connectors 56, 57, 58, 59 located in the corners of the box.

Figure 6:
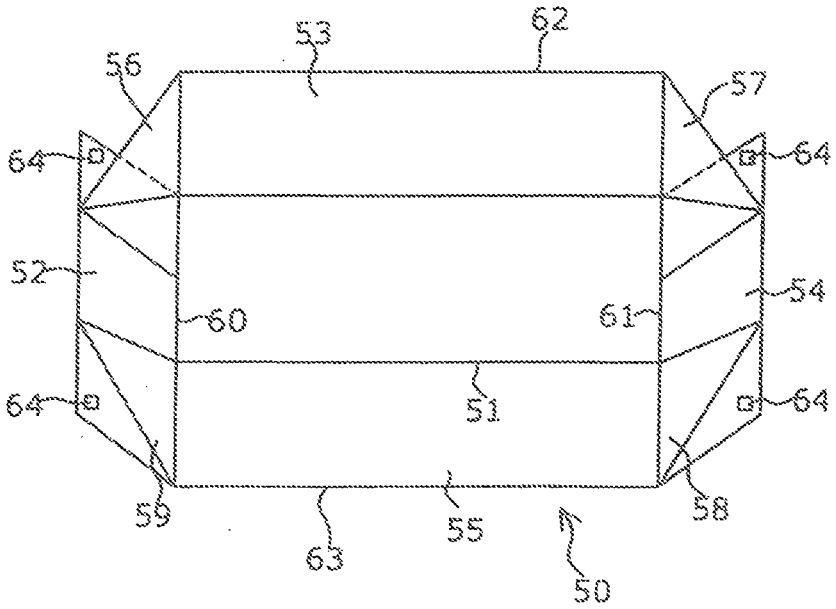
FIG. 6 is a perspective view of the second embodiment of the present invention in its transition from a flat unfolded box to its constructed form.

FIG. 6 shows the box in a partially assembled state. Here, sides 52 and 54 are connected to the bottom at crease. Sides 52 and 54 are also connected to the bottom at crease 60 and 61.

Also shown are the four connectors 56-59. These connectors 56-59 are foldably attached to the edge of each side. That is, side 52 is attached to side 53 by connector 56. Side 53 is attached to side 54 by connector 57. Side 54 is attached to side 55 by connector 58. Side 55 is attached to side 52 by connector 59.

Also shown on sides 52 and 54 are additional means 64 for ensuring that the sides of the box are tightly in place. This makes sure that when a user folds the box 50, the box 50 will not inadvertently collapse while in use.

The additional means 64 can be an adhesive, tape or Velcro strip. This additional means 64 is already in place when a user assembles the box. The user does not need any additional items to make the box.

A securing means (not shown) can also be attached to a side of the box as will be discussed in detail in FIGS. 8-10. This securing means adds additional strength to the box when the box is constructed by a user. That is, when the sides are in their upright position the securing means ensures the box will not collapse when the box is in use.

Figure 7:
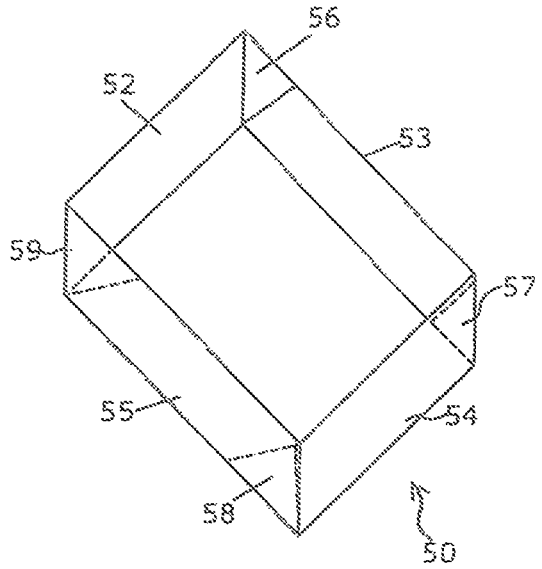
FIG. 7 is a perspective view of the second embodiment of the present invention in its constructed form.

FIG. 7 shows the box in its constructed state. The sides 52-55 are in their upright position with the bottom face down. The additional securing means 64 are not visible when the box 50 in its constructed state.

Figure 8:
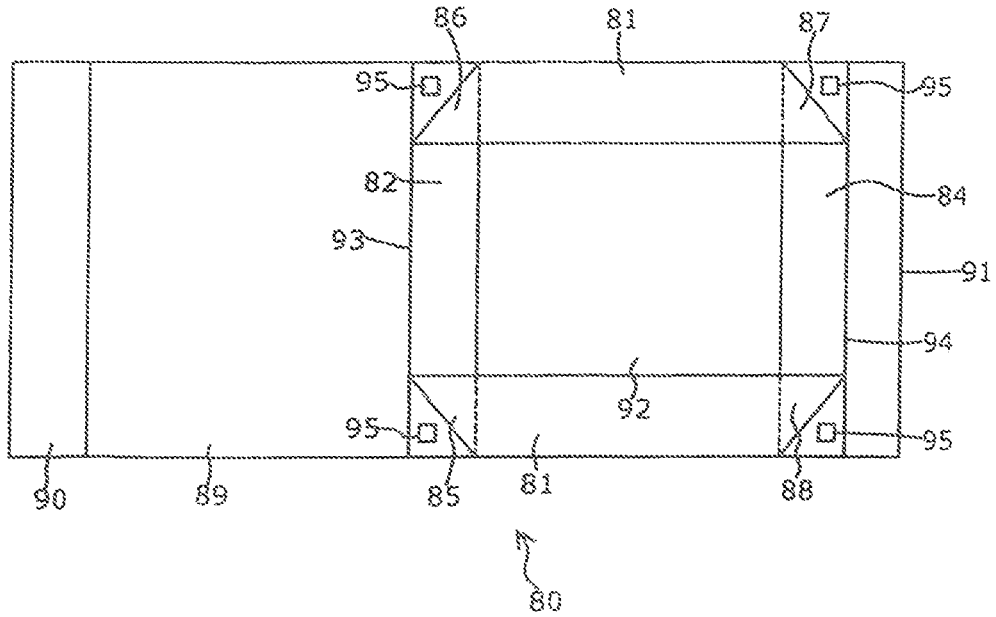
FIG. 8 is a top view of the third embodiment of the present invention in its flat, unfolded form.

FIG. 8 shows a third embodiment of the present invention. In this embodiment the sides 81-84 and the bottom 92 are constructed as in the second embodiment. However, in this embodiment the cover 89 is integrated into the construction of the box 80. During shipping, when the box 80 is in its flat state, the cover 89 and lip 90 may be turned 180 degrees and stored against the bottom 92 of the box 80.

The sides 81-84 are constructed with a cover 89 being foldably attached to side 82 at crease 93. The cover 89 is then attached to lip 90 for securing the cover 89 to the constructed box 80 at side 84.

A securing means 91 is attached to side 84 at crease 94. This securing means 91 adds additional strength to the box when the box is constructed by a user. That is when the sides are in their upright position the securing means is placed between 81 and 83. This ensures the box 80 will not collapse when the box 80 is in use.

The box also may have additional means 95 for ensuring that the sides of the box are tightly in place. The additional means 95 can be an adhesive, tape or Velcro strip. This additional means 95 is already in place when a user assembles the box. The user does not need any additional items to make the box.

Figure 9:
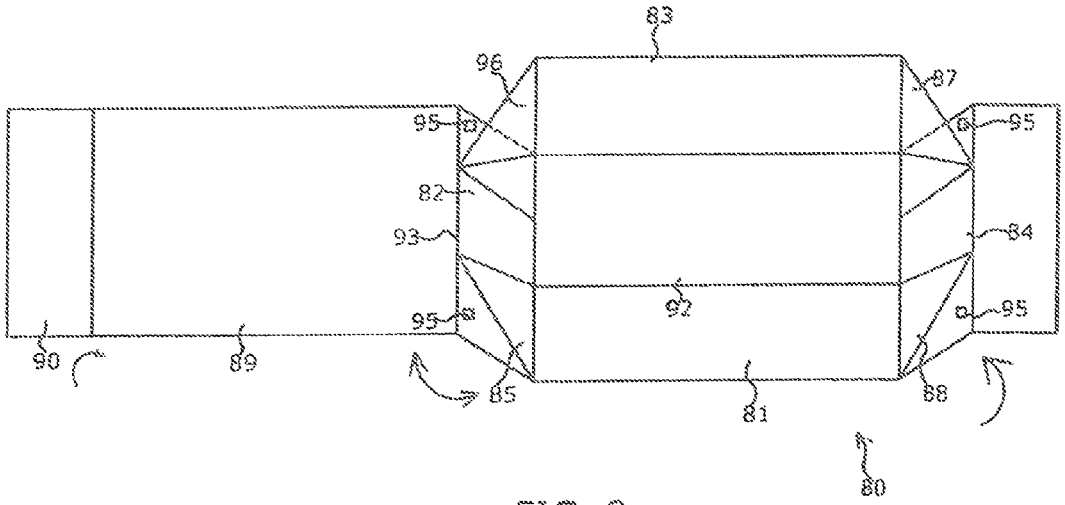
FIG. 9 is a perspective view of the third embodiment of the present invention in its transition from a flat unfolded box to its constructed form.

FIG. 9 shows the box 80 in a transition state between folded and unfolded. The box 80 as it is being lifted from its unfolded state will raise the sides 81-84 of the box 80.

Figure 10:
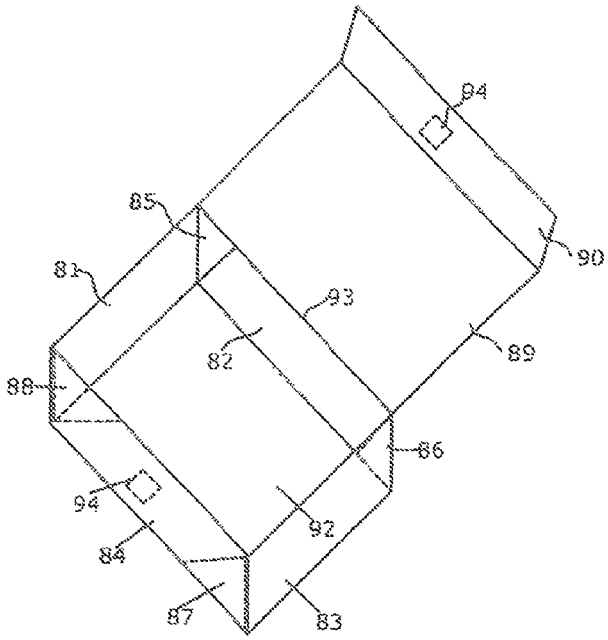
FIG. 10 is a perspective view of the third embodiment of the present invention in its constructed form.

FIG. 10 shows the box 80 with the sides 81-84 raised. To fully close the box 80, the cover 89 is thrown over the open area created by the sides 81-84. The cover 80 is then secured as a lid to the sides by the use of a locking means 94 such as a magnet which may be located between the surfaces of the box. However, other types of locking means such as snaps may be placed on the lip and the sides to lock the cover 89 in place.

In this specification, the invention has been described with reference to specific exemplary embodiments thereof. However it is evident that various modifications and changes may be made thereto without departing from the broader spirit and scope of the invention as set forth in the claims that follow. The specification and drawings are accordingly to be regarded in an illustrative manner rather than a restrictive sense.

The invention claimed is:

1. A foldable box comprising:

a cover; a bottom; a right side; a front side; a left side; a rear side; an outside connector; a front connector; and a rear connector, the cover being foldably connected to the outside connector at a first crease, the bottom being foldably connected to the outside connector at a second crease, the right side being foldably connected to the front side at a third crease, the front side being foldably connected to the left side at a fourth crease, the left side being foldably connected to the rear side at a fifth crease, the rear side being foldably connected to the right side at a sixth crease, the front connector having a first portion and a second portion being separated by a seventh crease, the rear connector having a third portion and a fourth portion being separated by an eighth crease, the first portion of the front connector being foldably connected to a bottom edge of the left side, the second portion of the front connector being foldably connected to a bottom edge of the front side, the third portion of the rear connector being foldably connected to a bottom edge of the rear side, the fourth portion of the rear connector being foldably connected to a bottom edge of the right side, the bottom edge of the left side being foldably connected to a left edge of the bottom, and one of said connectors being secured to said bottom in a flat position of the box, wherein the foldable box is constructed from the flat position into a three-dimensional position in a single fluid motion.

2. The foldable box of claim 1, wherein when the box is in three-dimensional form, the right side, the front side, the left side and the rear side are in upright positions.

3. The foldable box of claim 2, wherein when the box is in three-dimensional form, the outside connector is folded over the rear side and the cover is folded over an opening created by the right side, the front side, the left side and the rear side.

4. The foldable box of claim 3, wherein when the box is in three-dimensional form, the front connector and the rear connector are adjacent to one another and lay flat against a top side of the bottom.

* * * * *